US008614650B2

(12) United States Patent
Wilson

(10) Patent No.: US 8,614,650 B2
(45) Date of Patent: Dec. 24, 2013

(54) TUNABLE INVERTED F ANTENNA

(75) Inventor: David Wilson, Toronto (CA)

(73) Assignee: Tyco Safety Products Canada Ltd., Concord, Ontario (CA)

( * ) Notice: Subject to any disclaimer, the term of this patent is extended or adjusted under 35 U.S.C. 154(b) by 839 days.

(21) Appl. No.: 12/748,605

(22) Filed: Mar. 29, 2010

(65) Prior Publication Data

US 2010/0245195 A1 Sep. 30, 2010

Related U.S. Application Data

(60) Provisional application No. 61/165,053, filed on Mar. 31, 2009.

(51) Int. Cl.
*H01Q 1/50* (2006.01)

(52) U.S. Cl.
USPC ..... 343/861; 343/860

(58) Field of Classification Search
USPC ..... 343/700 MS, 702, 745, 795, 846, 850, 343/860, 861, 862, 876
See application file for complete search history.

(56) References Cited

U.S. PATENT DOCUMENTS

| | | | | |
|---|---|---|---|---|
| 6,466,176 | B1 | 10/2002 | Maoz et al. | |
| 6,741,214 | B1 | 5/2004 | Kadambi et al. | |
| 6,933,894 | B2 | 8/2005 | Ghosh et al. | |
| 7,277,337 | B1 * | 10/2007 | Co et al. | 365/200 |
| 7,339,531 | B2 | 3/2008 | Desclos et al. | |
| 7,372,406 | B2 * | 5/2008 | Shiotsu et al. | 343/700 MS |
| 7,388,543 | B2 | 6/2008 | Vance et al. | |
| 7,602,343 | B2 | 10/2009 | Takada | |
| 7,825,863 | B2 | 11/2010 | Martiskainen | |
| 2003/0151555 | A1 | 8/2003 | Holshouser | |
| 2007/0126640 | A1 | 6/2007 | Lee | |
| 2007/0222697 | A1 * | 9/2007 | Caimi et al. | 343/861 |
| 2009/0174606 | A1 | 7/2009 | Qian et al. | |
| 2010/0245198 | A1 | 9/2010 | Wilson | |
| 2011/0109515 | A1 | 5/2011 | Rao | |

FOREIGN PATENT DOCUMENTS

| | | | |
|---|---|---|---|
| WO | WO 03/010854 | A1 | 2/2003 |
| WO | WO 2005/112280 | A1 | 11/2005 |

OTHER PUBLICATIONS

Canadian Intellectual Property Office, International Search Report, Completed: Jul. 21, 2010 for International Application No. PCT/CA2010/000489.
Office Action for U.S. Appl. No. 12/748,804; Mailing date: Jun. 22, 2012.
Final Office Action for U.S. Appl. No. 12/748,804; Mailing date: Dec. 11, 2012.
Patent Cooperation Treaty, International Search Report, mailed Jul. 15, 2010, for International Application No. PCT/CA2010/000490.

* cited by examiner

*Primary Examiner* — Hoang V Nguyen
*Assistant Examiner* — Kyana R McCain
(74) *Attorney, Agent, or Firm* — Kacvinsky Daisak pllc

(57) ABSTRACT

A planar antenna includes a ground plane on a substrate, a radiating element coupled to the ground plane on the substrate, and a feed line. An impedance tap point is defined by a connection between the feed line and the radiating element and the length of the radiating element defines the resonant frequency of the antenna. A first portion of the radiating element includes an impedance adjustment mechanism for defining the impedance tap point of the antenna and consequently the impedance of the antenna. A second portion of the radiating element includes a frequency adjustment section which adjusts the length of said radiating element and consequently the resonant frequency of the antenna.

25 Claims, 6 Drawing Sheets

TUNABLE INVERTED F ANTENNA

CROSS-REFERENCE TO RELATED APPLICATION

This application claims the priority benefit of U.S. Provisional Patent Application No. 61/165,053 filed Mar. 31, 2009 the entire disclosure of which is herein incorporated by reference.

BACKGROUND OF THE INVENTION

1. Field of the Invention

Embodiments of the present, disclosure relate to planar antennas that may be disposed on printed circuit boards (PCBs) or other substrates. More particularly, the present disclosure relates to a planar tunable inverted-F antenna (IFA).

2. Discussion of Related Art

Security or alarm systems are installed in premises to detect hazardous or potentially hazardous conditions. A security system generally includes a plurality of detectors/sensors, one or more keypads, and a control panel which contains the system electronics and may include a communication interface (communicator) for remote monitoring and two-way communication over telephone or wireless communication paths. Each of the detectors communicates with the control panel to provide notification of an alarm condition. Examples of possible alarm conditions include unauthorized entry or the unexpected presence of a person who may be an intruder, fire, smoke, toxic gas, high/low temperature conditions (e.g., freezing), flooding, power failure, etc. In other words, an alarm condition may represent any detectable condition that might lead to personal hazard or property damage. Audible and/or visible alarm devices such as sirens, lights, etc., may also be utilized to notify occupants of the existence of an alarm condition. The control panel may be located in a utility room, basement, etc., and may communicate with the detectors and notification devices by wired, wireless or alternative signal paths. A keypad, which may also communicate with the control panel via a wired or wireless connection, is used to arm/disarm the system as well as to provide a means to display various system messages via a status display screen. In certain designs, the keypad and control panel may be integrally housing within a single unit.

FIG. 1 is a block diagram of a security system 10 installed in a building or premises. Security system 10 includes a control panel 20 which generally controls operation of the system. A number of detection devices $\mathbf{18}_1 \ldots \mathbf{18}_N$ are utilized to monitor an area. Detection devices may include, for example, motion detectors, door contacts, glass break detectors, smoke detectors, water leakage detectors, gas detectors, etc. Detection devices $\mathbf{18}_1 \ldots \mathbf{18}_N$ communicate with panel 20 by a dedicated wired interconnect 18A, wirelessly 18B, through the electric (i.e. power) wiring of the premises 18C, or otherwise. One or more user interfaces, such as keypad 25 is used to communicate with control panel 20 to arm, disarm, notify and generally control system 10.

Control panel 20 communicates with each of the detection devices $\mathbf{18}_1 \ldots \mathbf{18}_N$, keypad 25 and personal device 19 as well as with an offsite monitoring service 30 which is typically geographically remote from the monitored premises in which system 10 is installed. Control panel 20 may include a CPU 34, memory 35, and communicator 36. CPU 34 functions as a controller to control the various communication protocols within system 10. Memory 35 stores system parameters, detection device information, address information, etc. Communicator 36 sends and receives signals to/from the monitoring facility 30 via communications link 31. Alternatively, communicator 36 may be a separate device that communicates with controller 20 via a hardwired or wireless connection.

Generally, when an alarm condition occurs based on the operation of one or more detection devices $\mathbf{18}_1 \ldots \mathbf{18}_N$, a signal is transmitted from the respective detection device to control panel 20. Depending on the type of signal received from the one or more detection devices, communicator 36 communicates with monitoring service 30 via link 31 to notify the monitoring service that an alarm condition or anomaly has occurred at the premises. Communication link 31 may be a POTS (Plain Old Telephone System) connection, a broadband connection (e.g., Internet), a cellular link such as GSM (Global System for Mobile communications) transmission, satellite communication, etc. In certain security systems, keypad 25, control panel 20 and communicator 36 may be housed within a single unit.

For wireless communication, the keypad 25, control panel 20, communicator 36, and detection devices $\mathbf{18}_1 \ldots \mathbf{18}_N$ each include an antenna for transmitting and receiving signals. These antennas are formed on a surface of a printed circuit board (PCB) on which the other electronics of the security system may be disposed. One example of such an antenna is an inverted-L antenna (ILA). ILAs may be re-tuned by changing reactive feed components such as discrete inductors and capacitors. However, ILAs have a directional radiation pattern, which is not desirable for security systems as it requires a precise installation of the various receivers and transmitters such that communication between the different components is possible.

Another example of an antenna is an inverted F antenna (IFA), which has a more favorable omni-directional radiation pattern compared to ILAs. However, conventional IFAs are incapable of tuning without changing the physical layout of the antenna on the PCB. For example, FIG. 2 illustrates an IFA 100 including a ground plane 102 and a radiating element 104 extending from ground plane 102. Radiating element 104 includes a ¼ wavelength radiating portion 106 disposed adjacent to an impedance tap point 108 where a feed line 110 intersects radiating element 104.

The impedance of IFA 100 is determined by the placement of impedance tap point 108, i.e., where feed line 110 intersects radiating element 104, along the length of radiating element 104. For example, placing feed line 110 such that tap point 108 is electrically closer to the ground plane 102 along ¼ wavelength radiating portion 106 decreases the impedance whereas placing feed line 110 in an opposite direction along the radiating element increases the impedance. Consequently, impedance adjustments to conventional IFAs require new PCBs to be fabricated or spun in order to place the feed line 110 at the desired point along radiating element 104.

To adjust the resonant frequency of an IFA, the length of the radiating element is shortened or lengthened. This also requires the fabrication of a new PCB on which the antenna is disposed. This limitation of conventional IFAs requires security system providers to develop separate PCB designs for various systems. For example, in systems installed in North America, signals are transmitted with a frequency of approximately 433 MHz. This requires an IFA configured for this frequency. Systems installed in Europe require signals transmitted with a frequency of approximately 868 MHz. Consequently, a different IFA configuration is required for this frequency. Accordingly, an improved planar IFA design is desirable that may be configured for various impedance and frequency transmissions.

SUMMARY OF THE INVENTION

Exemplary embodiments of the present disclosure are directed to a tunable inverted-F antenna (IFA). In one exemplary embodiment, the IFA includes a ground plane extending in a first direction on a substrate, a radiating element coupled to the ground plane on the substrate and a feed line coupled to the radiating element. The coupling of the feed line and the radiating element define an impedance tap point of the antenna. An impedance adjustment mechanism is disposed along a length of the radiating element and the feed line. The impedance adjustment mechanism includes at least one pair of contacts between the radiating element and the feed line, wherein the coupling of the at least one pair of contacts defines the impedance tap point of the antenna.

In another exemplary embodiment, a planar antenna includes a ground plane extending in a first direction on a substrate, a radiating element coupled to the ground plane on the substrate where the radiating element has a length that defines a resonant frequency of the antenna, and a feed line coupled to the radiating element. A frequency adjustment section is disposed along a length of the radiating element. The frequency adjustment section includes at least one pair of contacts separated by a gap, wherein coupling of the at least one pair of contacts defines the length of the radiating element and consequently the frequency of the antenna.

In another exemplary embodiment, a planar antenna includes a ground plane extending in a first direction. A radiating element has a first section extending from the ground plane in a second direction and a second section extending from the first section in a third direction. A feed line is coupled to the second section of the radiating element. A first conductive trace is disposed adjacent to the second section of the radiating element for adjusting a length of the radiating element. A second conductive trace is disposed adjacent to the first section of the radiating element for adjusting an impedance of the planar antenna.

DESCRIPTION OF EMBODIMENTS

Figure 1:
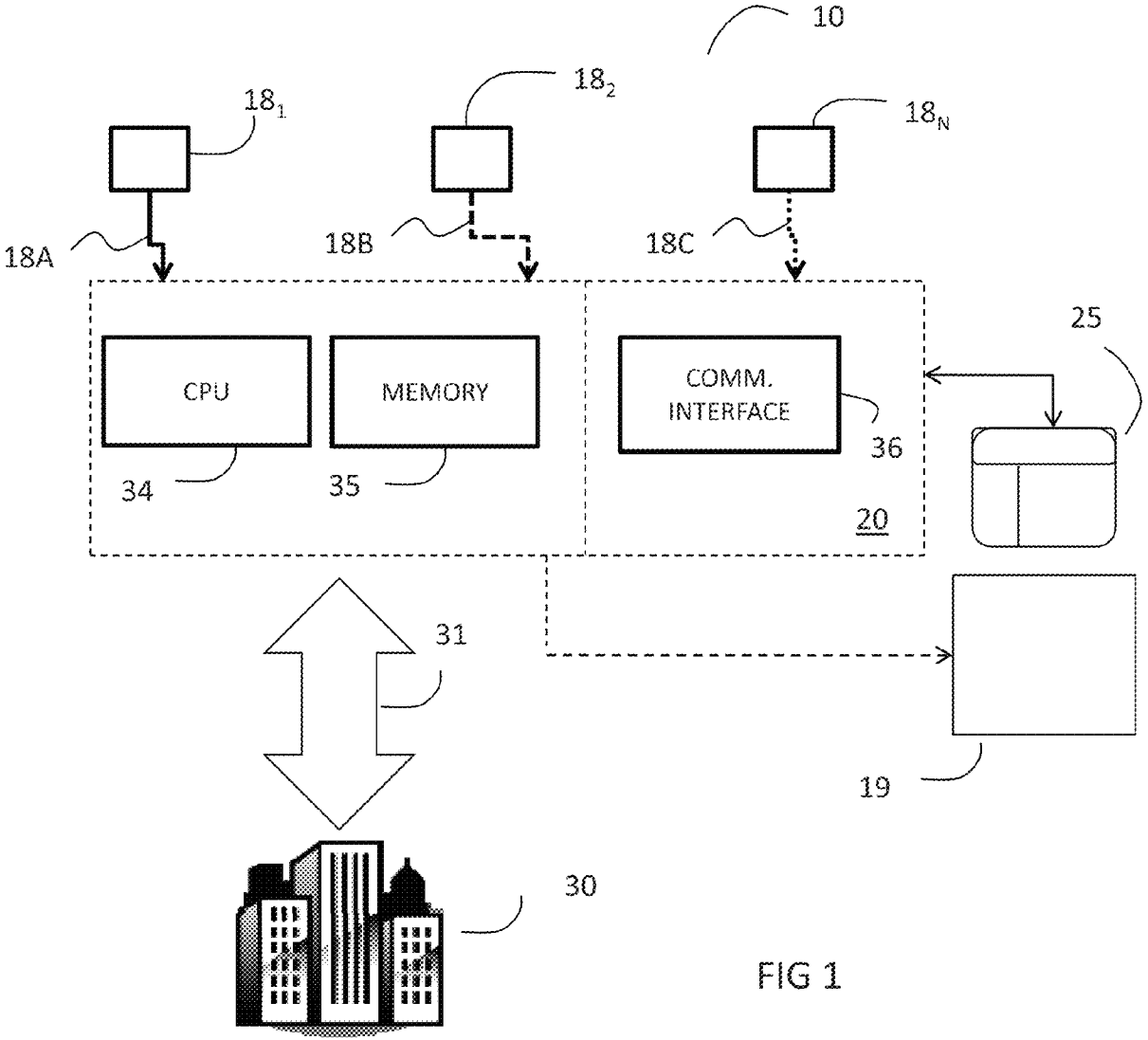
FIG. 1 illustrates a block diagram of a security system.
Figure 2:
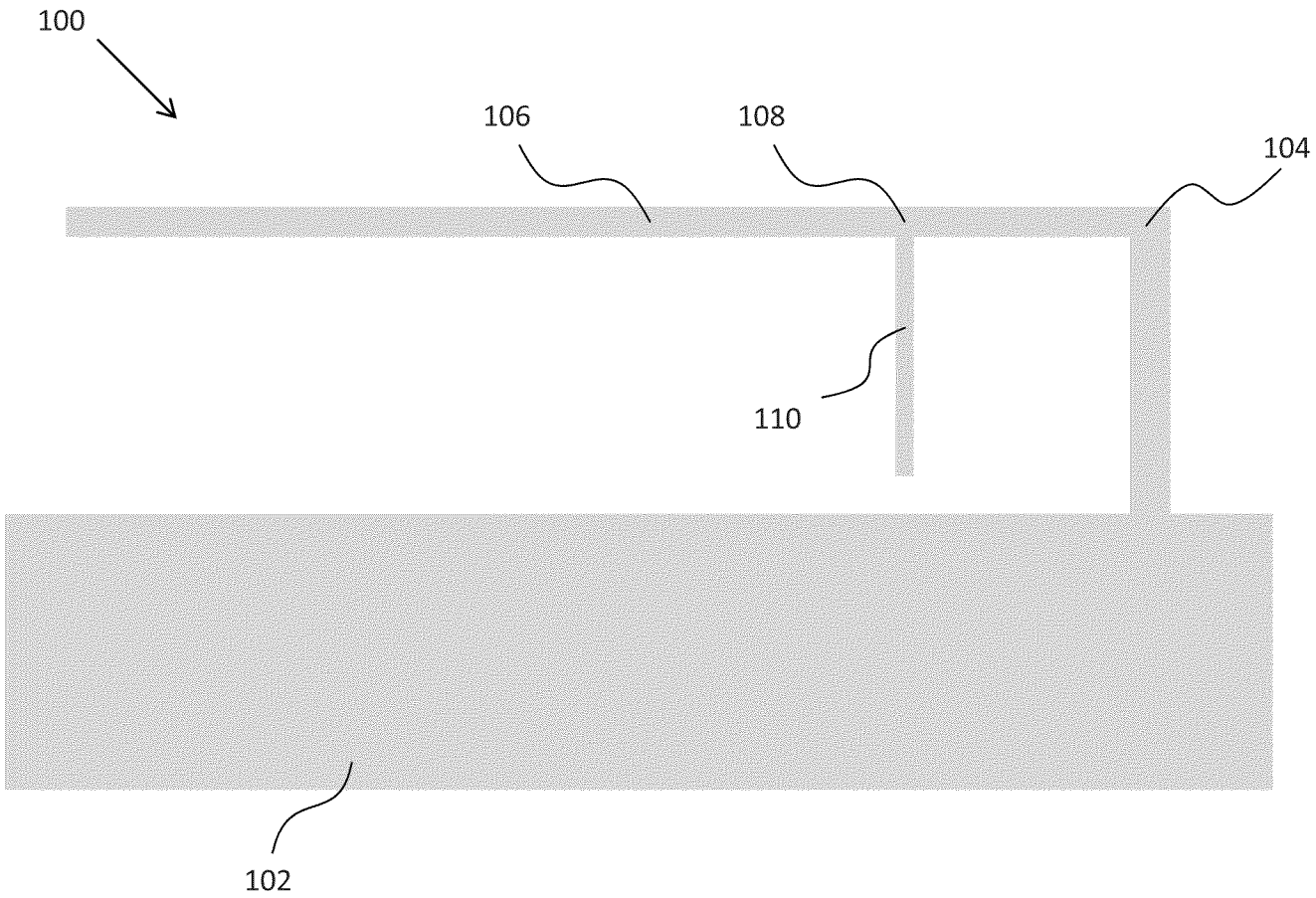
FIG. 2 (PRIOR ART)
FIG. 2 illustrates a layout of a conventional inverted-F antenna.

The present disclosure will now be described more fully hereinafter with reference to the accompanying drawings, in which preferred embodiments of the invention are shown. This invention, however, may be embodied in many different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout.

Figure 3:
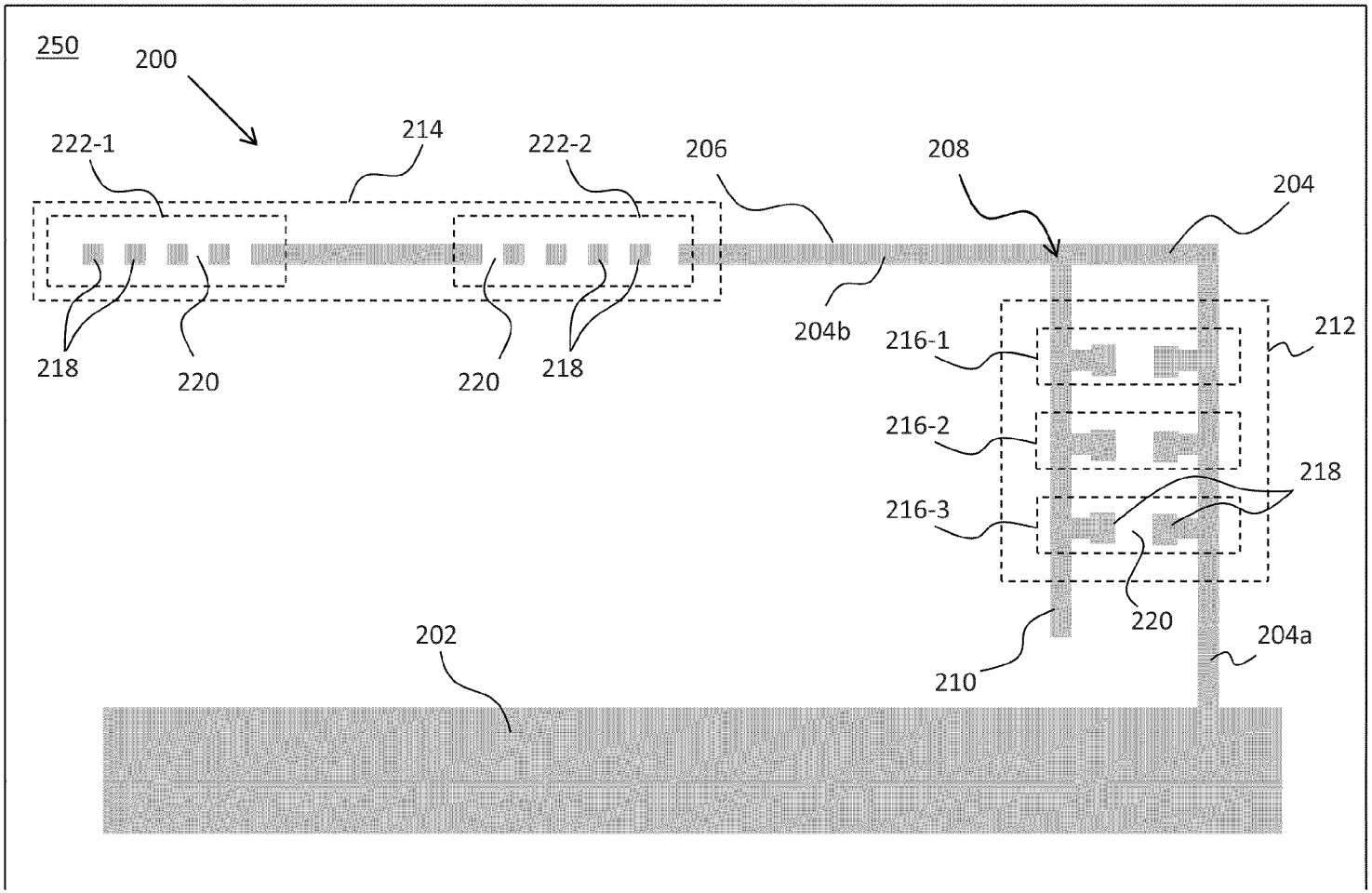
FIG. 3 is a layout view of a tunable inverted-F antenna in accordance with an embodiment of the present disclosure.

FIG. 3 is a layout of an improved planar inverted-F antenna (IFA) 200 including a ground plane 202 and a radiating element 204. Radiating element 204 includes a first portion 204*a* extending from ground plane 202 in a substantially perpendicular direction with respect to the ground plane 202. A second portion 204*b* extends from first portion 204*a* in a substantially perpendicular direction with respect to first portion 204*a*. Second portion 204*b* of radiating element 204 includes a partial wavelength radiating portion 206, e.g., ¼ wavelength, ½ wavelength, or the like, disposed adjacent to an impedance tap point 208 where feed line 210 intersects second-portion 204*b* of radiating element 204. This configuration defines the typical "F" shape associated with an IFA. Ground plane 202, radiating element 204, and feed line 210 may be formed from a conductive material including, but not limited to, copper, silver, gold, tungsten, or the like, disposed on a dielectric substrate or printed circuit board (PCB) 250.

IFA 200 includes an impedance adjustment mechanism 212 and/or a frequency adjustment mechanism 214. In particular, impedance adjustment mechanism 212 includes at least one of impedance adjustment sections 216-1, 216-2, and 216-3 (collectively "adjustment sections 216"). Although three impedance adjustment sections 216 are illustrated in FIG. 3, one skilled in the art will understand that fewer or more impedance adjustment sections 216 may be implemented. Each impedance adjustment section 216 includes a pair of conductive contacts 218 separated by a gap 220. Contacts 218 may be directly coupled to first radiating element portion 204*a* and feed line 210 (not shown), or (as shown) contacts 218 may be coupled to first radiating element portion 204*a* and feed line 210 through conductive traces.

Frequency adjustment mechanism 214 may also include one or more frequency adjustment sections 222-1 and 222-2 (collectively "frequency adjustment sections 222") each including a plurality of contacts 218. Contacts 218 are separated by a gap 220 and may be coupled to conductive trace sections of second portion of radiating element 204*b* to extend the length of partial 206. Contacts 218 may be formed from solder or other conductive material used in planar technology (SMT) to mount circuit elements on a surface of a substrate such as, for example a zero-ohm resistor.

Figure 3A:
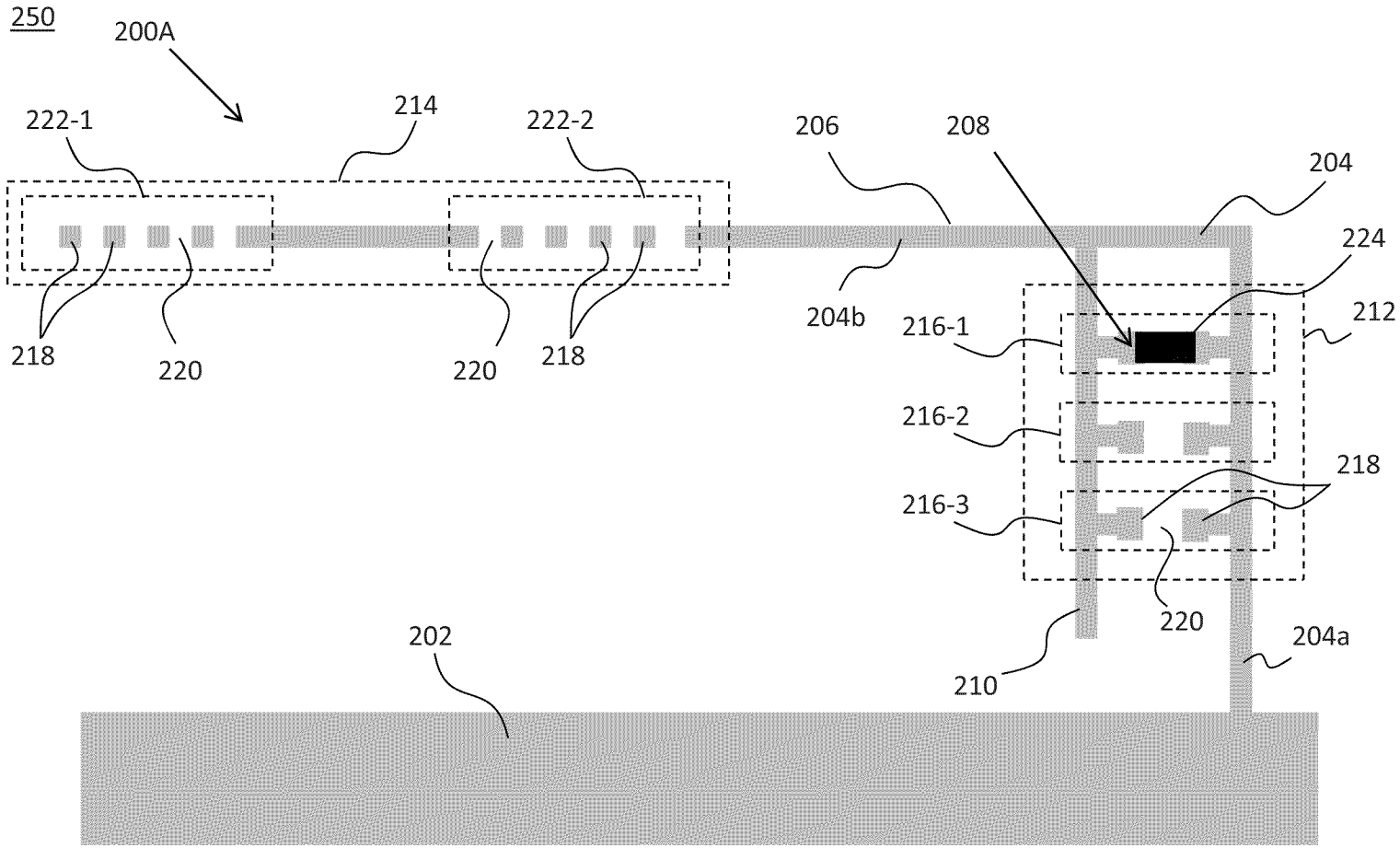
FIG. 3A is a layout view of the tunable inverted-F antenna illustrated in FIG. 3 including a coupling member for adjusting the impedance of the antenna.

The impedance of the IFA 200 may be adjusted by electrically connecting a pair of contacts 218 separated by a gap 220 using a coupling member. For example, FIG. 3A illustrates an IFA 200A in which a coupling member 224 is connected across contacts 218 of impedance adjustment segment 216-1. Coupling member 224 may be a zero-ohm resistor or other device having a low resistance for coupling together contacts 218. With contacts 218 of impedance adjustment segment 216-1 coupled together, the effective location of the impedance tap point 208 along the length of radiating element 204 is altered, which adjusts the impedance of IFA 200A. In particular, positioning coupling member 224 closer to ground plane 202, i.e., farther down the impedance adjustment ladder defined by impedance adjustment mechanism 212, decreases the impedance of IFA 200A as the location of the impedance tap point 208 is effectively moved along radiating element 204.

In an alternative embodiment, feed line 210 can be connected to radiating element portion 204*a* by a plurality of traces forming the impedance adjustment mechanism 212 and based on the desired impedance, one or more of these connections may be severed or cut. This also provides an impedance adjustment ladder, but instead of coupling contacts 218 with a coupling member 224, the connections are already in place and the connections not corresponding to the desired impedance in the ladder are cut or otherwise decoupled.

Figure 3B:
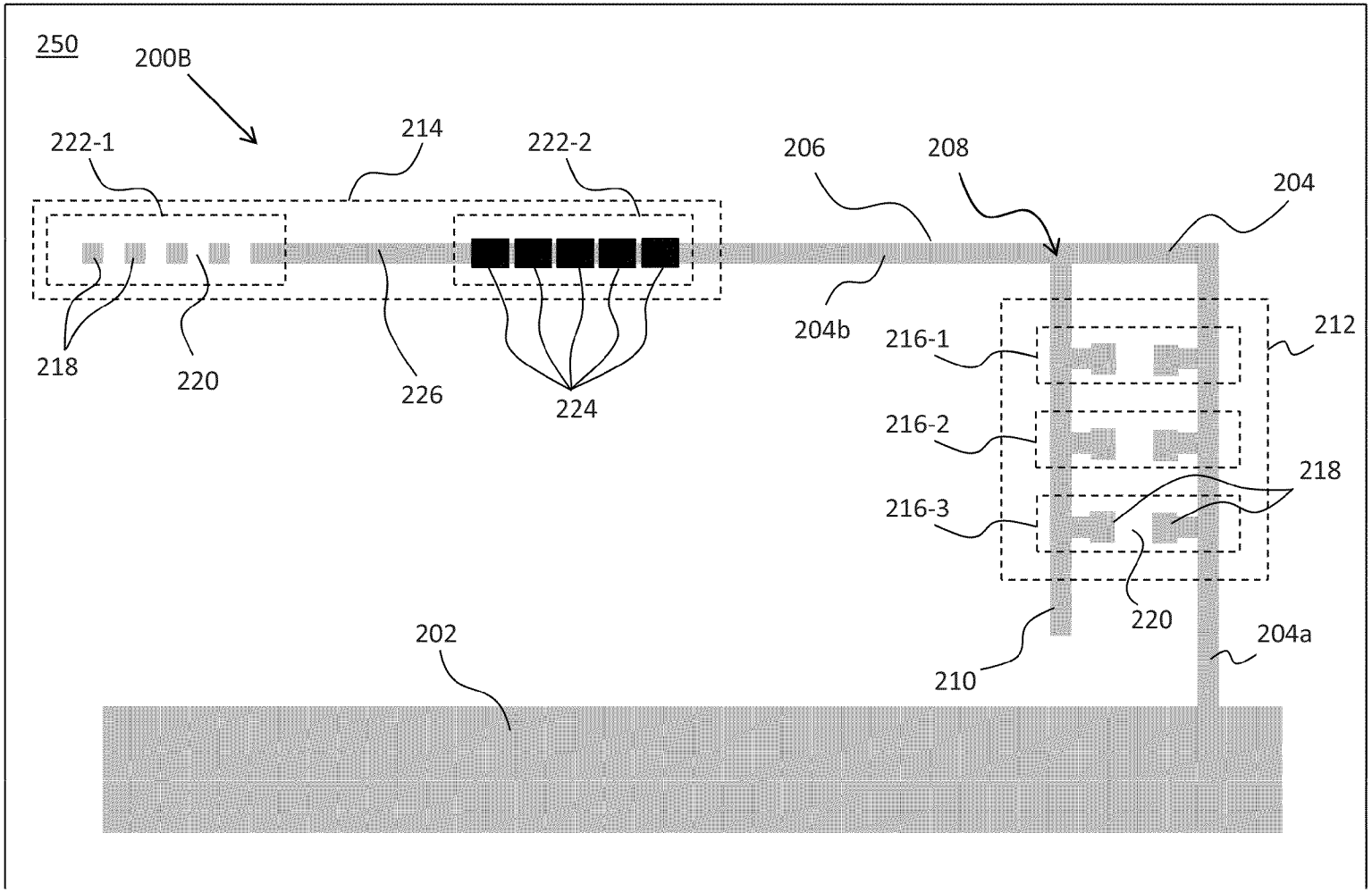
FIG. 3B is a layout view of the tunable inverted-F antenna illustrated in FIG. 3 including coupling member for adjusting the resonant frequency of the antenna.

The resonant frequency of IFA 200 may be adjusted by using one or more coupling members 224 to connect contacts 218 of frequency adjustment mechanism 214 to increase the length of partial wavelength radiating element 206 as shown in FIG. 3B. Increasing the length of the radiating element 204, and more particularly the partial wavelength radiating element 206 of radiating element 204, decreases the resonant frequency of IFA 200B. The distance between contacts 218 may be configured to provide a desired frequency adjustment increment. For example, increasing a length of partial wavelength radiating element 206 by approximately 7.5 mm would decrease the resonant frequency by approximately 16 MHz in accordance with the equation $f=v/\lambda$ where $\lambda$ is the wavelength of the signal wave, f is the frequency of the wave, and v is the speed of the wave. One skilled in the art will understand that distance between the contacts and the lengths of the conductive traces may be selected to provide various frequency adjustment increments such as, for example, but not limited to, 5 MHz, 10 MHz, 15 MHz, and 20 MHz, to name a few.

Longer trace lengths, such as trace 226 (FIG. 3B) coupled between frequency adjustment sections 222-1 and 222-2, may be implemented for configuring IFA 200A for use in different frequency bands. For example, IFA 200A may be configured to resonate at approximately 868 MHz when frequency adjustment section 222-2 is not fully populated with coupling members 224, i.e., trace 226 is not coupled to radiating element 206. With frequency adjustment section 222-2 fully populated with coupling members 224, such as illustrated in FIG. 3B, IFA 200B may be configured to resonate at approximately 433 MHz due to conductive trace 226 being coupled to partial wavelength radiating element 206.

In an alternative embodiment, contacts 218 of frequency adjustment sections 222-1 and 222-2 may be initially coupled and particular ones of these contacts may be cut or decoupled to determine the length of radiating element 206 depending on the desired resonant frequency. In other words, instead of initially having the contacts 218 uncoupled, the contacts 218 are coupled together and, depending on the desired resonant frequency (length of radiating element 206) certain of these coupling are cut or otherwise decoupled.

Figure 3C:
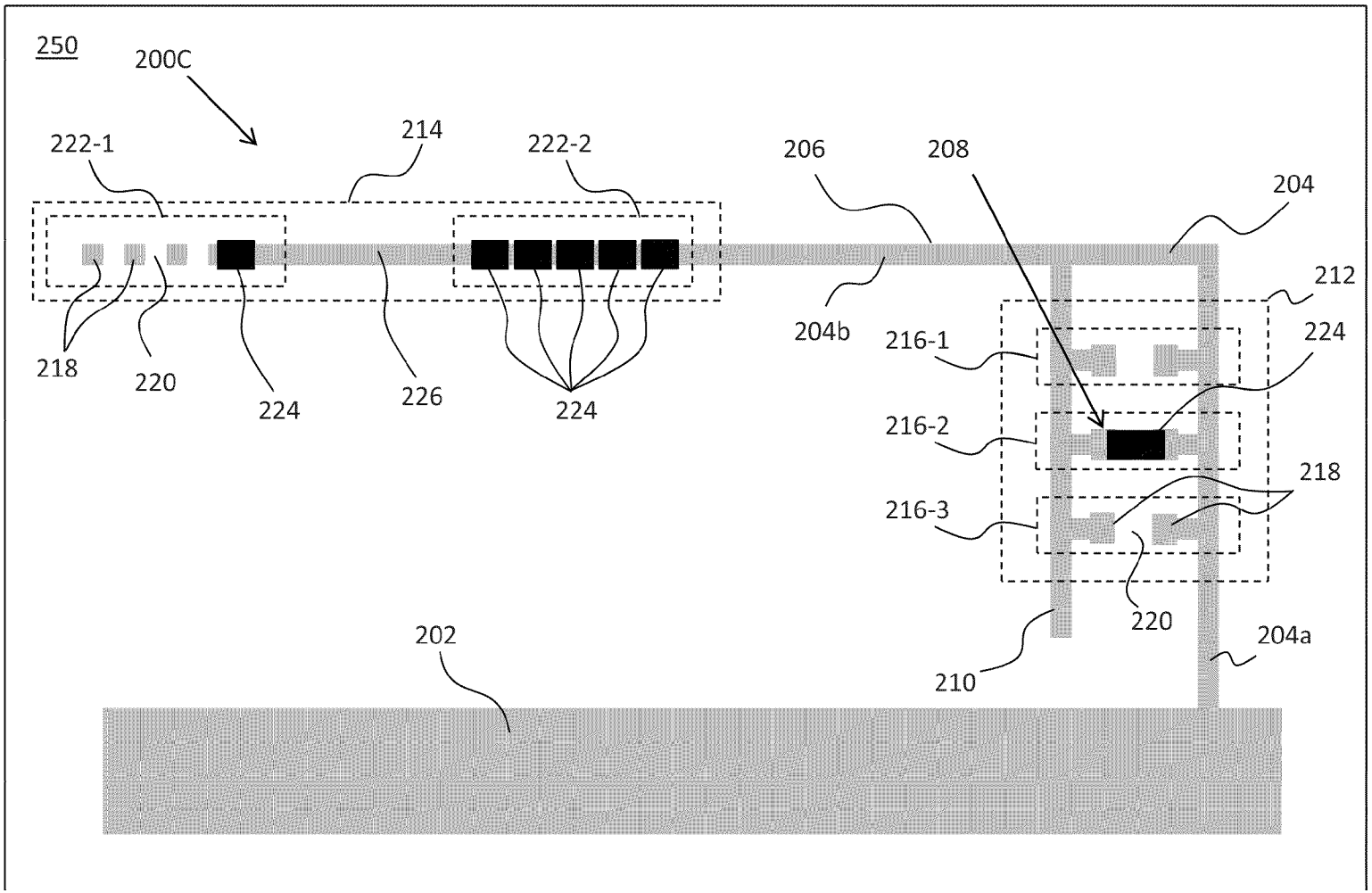
FIG. 3C is a layout view of the tunable inverted-F antenna illustrated in FIG. 3 including a plurality of coupling members for adjusting both the resonant frequency and impedance of the antenna.

The frequency and impedance of IFA 200 may be simultaneously tuned as illustrated in FIG. 3C. For example, IFA 200C includes a coupling member 224 coupled between contacts 218 of impedance adjustment section 216-2 to provide an impedance adjustment, i.e., adjust the effective distance of impedance tap point 208 along the length of radiating element 204. In addition, frequency adjustment section 222-2 may be fully populated with a plurality of coupling members 224 such that trace 226 is coupled to radiating element 206 to decreasing the resonant frequency of IFA 200C. Frequency adjustment section 222-1 includes one coupling member 224 coupled between a pair of contacts 218 to provide a fine tune frequency adjustment.

The tunable IFA disclosed herein advantageously enables frequency and/or impedance adjustments to be made to the IFA without requiring the time and expense of having a separate PCB's designed and fabricated. Additionally, the tunable IFA enables the design and implementation of a single PCB that may be configured for use in various regions of the world that utilize different frequencies for wireless communication. Consequently, the tunable IFA enables security system providers to reduce the costs associated with the design and manufacture of PCBs in their security systems.

While the present invention has been disclosed with reference to certain embodiments, numerous modifications, alterations and changes to the described embodiments are possible without departing from the sphere and scope of the present disclosure, as defined in the appended claims. Accordingly, it is intended that the present invention not be limited to the described embodiments, but that it has the full scope defined by the language of the following claims, and equivalents thereof.

What is claimed is:

1. A planar antenna, comprising:

a ground plane extending in a first direction on a substrate;

a radiating element coupled to the ground plane on the substrate, said radiating element defined by a first portion extending in a substantially perpendicular direction from the ground plane, and a second portion extending in a substantially perpendicular direction from said first portion of the radiating element;

a feed line coupled to the radiating element, said feed line disposed between the second portion of the radiating element and the ground plane, said coupling defining an impedance tap point of said antenna; and an impedance adjustment mechanism disposed in the first portion of the radiating element, said impedance adjustment mechanism comprises at least one pair of contacts between the radiating element and the feed line, wherein coupling of the at least one pair of contacts alters the impedance tap point of the antenna.

2. The planar antenna of claim 1, wherein a gap is defined between the at least one pair of contacts, said antenna further comprising a coupling member to connect said at least one pair of contacts.

3. The planar antenna of claim 2, wherein the coupling member is a zero-ohm resistor.

4. The planar antenna of claim 1, wherein said at least one pair of contacts is a first pair of contacts, said antenna further comprising a second pair of contacts, one of the second pairs of contacts is coupled to the feed line and the other one of the second pairs of contacts is coupled to the first portion of the radiating element.

5. The planar antenna of claim 4, wherein the impedance adjustment mechanism includes a zero-ohm resistor coupled to the second pair of contacts.

6. The planar antenna of claim 1 wherein the radiating element has a length that defines a resonant frequency of the antenna.

7. The planar antenna of claim 1 wherein the radiating element has a length that defines a resonant frequency of the antenna, said antenna further comprising a frequency adjustment section disposed along a length of the radiating element, said frequency adjustment section including at least one pair of contacts separated by a gap, wherein coupling of the at least one pair of contacts defines the length of said radiating element and consequently the resonant frequency of said antenna.

8. A planar antenna, comprising:

a ground plane extending in a first direction on a substrate;

a radiating element coupled to the ground plane on the substrate, said radiating element defined by a first portion extending in a substantially perpendicular direction from the ground plane, and a second portion extending in a substantially perpendicular direction from said first portion of the radiating element, said radiating element having a length that defines a resonant frequency of the antenna;

a feed line coupled to the radiating element; and a frequency adjustment section disposed along a length of the radiating element, said frequency adjustment section including at least one pair of contacts separated by a gap, wherein coupling of the at least one pair of contacts defines the length of said radiating element and consequently the resonant frequency of said antenna; and a conductive trace disposed adjacent to the first portion of the radiating element for adjusting an impedance of the planar antenna.

9. The planar antenna of claim 8 wherein said frequency adjustment section is a first frequency adjustment section, said antenna further comprising a second frequency adjustment section disposed along the length of the radiating element a distance from the first frequency adjustment section, said second frequency adjustment section including at least one pair of contacts separated by a gap, wherein coupling of the at least one pair of contacts defines the length of said radiating element and consequently the resonant frequency of said antenna.

10. The planar antenna of claim 8 wherein said ground plane extends in a first direction on a surface of a printed circuit board (PCB), the feed line extends from the ground plane in a second direction on the surface of the PCB, and the radiating element is disposed on the surface of the PCB, the radiating element including:

a first segment extending from the ground plane in the second direction, a second segment extending from the first segment in a substantially perpendicular direction with respect to the second direction wherein said frequency adjustment section is disposed along said second segment.

11. The planar antenna of claim 8, further comprising a coupling member configured to couple said at least one pair of contacts.

12. The planar antenna of claim 11, wherein the coupling member is a zero-ohm resistor.

13. The planar antenna of claim 8 wherein said coupling of the feed line to the radiating element defines an impedance tap point of said antenna, said antenna further comprising an impedance adjustment mechanism disposed along a length of the radiating element and the feed line, said impedance adjustment mechanism including at least one pair of contacts between the radiating element and the feed line, wherein coupling of the at least one pair of contacts defines the impedance tap point of the antenna.

14. A planar antenna, comprising:

a ground plane extending in a first direction;

a radiating element having a length that defines a resonant frequency of the antenna, said radiating element having a first section extending from the ground plane in a second direction and a second section extending from the first section in a third direction;

a feed line coupled to the second section of the radiating element;

a first conductive trace disposed adjacent to the second section of the radiating element for adjusting a length of the radiating element and consequently the resonant frequency of the antenna; and a second conductive trace disposed adjacent to the first section of the radiating element for adjusting an impedance of the planar antenna.

15. The planar antenna of claim 14, further comprising a first coupling element coupled to the first conductive trace and the second section of the radiating element.

16. The planar antenna of claim 15, further comprising a second coupling element coupled to the second conductive trace and the first section of the radiating element.

17. The planar antenna of claim 14, further comprising a first coupling element coupled to the second conductive trace and the first section of the radiating element.

18. The planar antenna of claim 14, wherein a first end of the first conductive trace is disposed adjacent to a first end of the second section of the radiating element, and a second end of the first conductive trace is disposed adjacent to a first end of a third conductive trace.

19. The planar antenna of claim 18, wherein the first conductive trace has a length sufficient to adjust a resonant frequency of the planar antenna by 10 MHz or more when the first conductive trace is coupled to the second section of the radiating element through a coupling member.

20. A planar inverted-F antenna comprising:

a ground plane extending in a first direction on a substrate;

a radiating element coupled to the ground plane on the substrate, said radiating element defined by a first portion extending in a substantially perpendicular direction from the ground plane, and a second portion extending in a substantially perpendicular direction from said first portion of the radiating element;

a feed line coupled to the radiating element, said feed line disposed between the second portion of the radiating element and the ground plane, said coupling defining an impedance tap point of said antenna;

an impedance adjustment mechanism disposed in the first portion of the radiating element and the feed line, said impedance adjustment mechanism comprises at least one pair of contacts between the radiating element and the feed line, wherein coupling of the at least one pair of contacts alters the impedance tap point of the antenna.

21. The planar inverted F antenna of claim 20 wherein the radiating element has a length that defines a resonant frequency of the antenna, said antenna further comprising a frequency adjustment section disposed along a length of the radiating element, said frequency adjustment section including at least one pair of contacts separated by a gap, wherein coupling of the at least one pair of contacts defines the length of said radiating element and consequently the resonant frequency of said antenna.

22. A method of adjusting an impedance of a planar inverted F antenna comprising:

providing a ground plane extending in a first direction on a substrate;

providing a radiating element coupled to the ground plane on the substrate, said radiating element defined by a first portion extending in a substantially perpendicular direction from the ground plane, and a second portion extending in a substantially perpendicular direction from said first portion of the radiating element;

providing a feed line coupled to the radiating element, said feed line disposed between the second portion of the radiating element and the ground plane, said coupling defining an impedance tap point of said antenna;

providing an impedance adjustment mechanism disposed between said a feed line and said first portion of said radiating element wherein the impedance adjustment mechanism comprises at least one pair of contacts between the radiating element and the feed line; and connecting the at least one pair of contacts to adjust an impedance tap point of the antenna, said impedance tap point defined by connection of said feed line to said radiating element.

23. A method of adjusting a resonant frequency of a planar inverted F antenna comprising:

providing a ground plane extending in a first direction on a substrate;

providing a radiating element coupled to the ground plane on the substrate, said radiating element defined by a first portion extending in a substantially perpendicular direction from the ground plane, and a second portion extending in a substantially perpendicular direction from said first portion of the radiating element;

providing a feed line coupled to the radiating element, said feed line disposed between the second portion of the radiating element and the ground plane;

providing a conductive trace disposed adjacent to the first portion of the radiating element for adjusting an impedance of the planar antenna;

providing a frequency adjustment section disposed along a length of a radiating element, said frequency adjustment section including at least one second pair of contacts separated by a gap; and coupling the at least one second pair of contacts to define the length of said radiating element and consequently the resonant frequency of said antenna.

24. A planar antenna, comprising:

a ground plane extending in a first direction on a substrate;

a radiating element coupled to the ground plane on the substrate, said radiating element defined by a first portion extending in a substantially perpendicular direction from the ground plane, and a second portion extending in a substantially perpendicular direction from said first portion of the radiating element;

a feed line coupled to the radiating element, said coupling defining an impedance tap point of said antenna;

an impedance adjustment means disposed in the first portion of the radiating element and the feed line, said impedance adjustment means configured to couple at least one pair of contacts between the feed line and the radiating element to alter the impedance tap point of the antenna.

25. A planar antenna, comprising:

a ground plane extending in a first direction on a substrate;

a radiating element coupled to the ground plane on the substrate, said radiating element defined by a first portion extending in a substantially perpendicular direction from the ground plane, and a second portion extending in a substantially perpendicular direction from said first portion of the radiating element, said radiating element having a length that defines a resonant frequency of the antenna;

a feed line coupled to the radiating element;

a frequency adjustment means disposed along a length of the radiating element, said frequency adjustment means configured to couple at least one pair of contacts to define the length of said radiating element and consequently the resonant frequency of said antenna; and a conductive trace disposed adjacent to the first portion of the radiating element for adjusting an impedance of the planar antenna.

* * * * *